US009238933B1

(12) United States Patent
Avissato

(10) Patent No.: US 9,238,933 B1
(45) Date of Patent: Jan. 19, 2016

(54) FRAMING ELEMENTS

(71) Applicant: Daniel Avissato, Staten Island, NY (US)

(72) Inventor: Daniel Avissato, Staten Island, NY (US)

( * ) Notice: Subject to any disclaimer, the term of this patent is extended or adjusted under 35 U.S.C. 154(b) by 0 days.

(21) Appl. No.: 14/256,075

(22) Filed: Apr. 18, 2014

Related U.S. Application Data

(60) Provisional application No. 61/821,306, filed on May 9, 2013.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E06B 1/04*** | (2006.01) |
| ***E04C 3/09*** | (2006.01) |
| *E04C 3/04* | (2006.01) |
| *E04C 3/07* | (2006.01) |
| *E04B 2/00* | (2006.01) |

(52) U.S. Cl.
CPC ... *E06B 1/04* (2013.01); *E04C 3/09* (2013.01); *E04C 2/46* (2013.01); *E04C 3/07* (2013.01); *E04C 2003/0421* (2013.01); *E04C 2003/0434* (2013.01); *E04C 2003/0452* (2013.01)

(58) Field of Classification Search
CPC ..... E04C 3/07; E04C 2003/0421; E04C 2003/0452; E04C 2003/0434; E04C 2/46
USPC ..... 52/481.1, 772, 842, 712, 710, 715, 696, 52/836, 653.1, 243, 741.13, 745.16, 52/745.19; D25/61
See application file for complete search history.

(56) References Cited

U.S. PATENT DOCUMENTS

| | | | | | |
|---|---|---|---|---|---|
| 3,043,408 | A | * | 7/1962 | Attwood | 52/842 |
| 3,058,173 | A | * | 10/1962 | Brydolf | 49/411 |
| 3,877,193 | A | * | 4/1975 | Hall | E04B 2/60 403/230 |
| 4,901,485 | A | * | 2/1990 | Menchetti et al. | 52/145 |
| 5,157,883 | A | * | 10/1992 | Meyer | 52/357 |
| 5,353,560 | A | * | 10/1994 | Heydon | B26D 3/006 52/241 |
| 5,412,919 | A | | 5/1995 | Pellock et al. | |
| 5,497,591 | A | | 3/1996 | Nelson | |
| 5,689,922 | A | | 11/1997 | Daudet | |
| 5,896,724 | A | * | 4/1999 | Tofts | 52/842 |
| 5,950,385 | A | * | 9/1999 | Herren | 52/481.1 |
| 5,953,876 | A | | 9/1999 | Agar | |
| 6,067,768 | A | * | 5/2000 | Colussi | 52/656.2 |
| 6,161,361 | A | * | 12/2000 | Ehrenkrantz | 52/847 |
| 6,199,336 | B1 | | 3/2001 | Poliquin | |
| 6,415,567 | B1 | * | 7/2002 | Mead | E04B 2/7422 160/135 |
| 6,457,292 | B1 | * | 10/2002 | Vrana | 52/842 |
| 6,609,344 | B2 | * | 8/2003 | Saldana | E04B 1/2403 52/243 |
| 6,854,397 | B2 | * | 2/2005 | Terajima et al. | 104/95 |

(Continued)

OTHER PUBLICATIONS

Super Stud Building Products, Inc., Framing the Future, Website, Jan. 3, 2014, 2 Pages, http://buysuperstud.com/.

(Continued)

*Primary Examiner* — Chi Q Nguyen
(74) *Attorney, Agent, or Firm* — Goldstein Law Offices, P.C.

(57) ABSTRACT

A framing element is provided. The framing element includes an F-shaped body defined via a spine, a first flange extending from the spine, and a second flange extending from the spine. The body is unitary. The first flange having a flange end portion distal to the spine. The flange end portion including a first track. The spine having a spine end portion distal to the first flange. The spine end portion including a second track. The second flange is between the first flange and the second track.

1 Claim, 6 Drawing Sheets

(56) References Cited

U.S. PATENT DOCUMENTS

| | | | | |
|---|---|---|---|---|
| 6,986,205 | B2 * | 1/2006 | Vrana | 29/897.3 |
| 7,216,465 | B2 | 5/2007 | Saldana | |
| D558,358 | S * | 12/2007 | DiGennaro | D25/60 |
| 7,832,171 | B2 | 11/2010 | Erickson et al. | |
| 7,836,657 | B1 * | 11/2010 | diGirolamo et al. | 52/712 |
| 8,132,376 | B2 | 3/2012 | Pilz et al. | |
| 8,234,836 | B2 | 8/2012 | Anderson | |
| 2002/0005024 | A1 * | 1/2002 | Hsueh | E04F 13/0807 52/764 |
| 2003/0029097 | A1 * | 2/2003 | Albracht | 52/27 |

OTHER PUBLICATIONS

SCAFCO Steel Stud Company, Website, Jan. 3, 2014, 1 Page, http://www.scafco.com/steel?gclid=COr4i6u94rsCFQ7x0godNDEA7A.

Marino Ware, More Control, Better Quality, and Options for Every Project/Frame Rite Connectors, Website, Jan. 3, 2014, 1 Page, http://www.marinoware.com/.

Clark Dietrich Building Systems, Before Our Steel Even Reaches the Jobsite, It Already Stands for Something Stronger, Website, Jan. 3, 2014, 1 Page, http://m.clarkdietrich.com/.

* cited by examiner

FRAMING ELEMENTS

CROSS-REFERENCE TO RELATED APPLICATIONS

The present application claims priority to U.S. Provisional Patent Application Ser. No. 61/821,306, filed on May 9, 2013, which is herein fully incorporated by reference for all purposes.

TECHNICAL FIELD

Generally, the present disclosure relates to construction. More particularly, the present disclosure relates to framing.

BACKGROUND

In the present disclosure, where a document, an act and/or an item of knowledge is referred to and/or discussed, whether directly and/or indirectly, then this reference and/or discussion is not an admission that the document, the act and/or the item of knowledge and/or any combination thereof was at the priority date, publicly available, known to the public, part of common general knowledge and/or otherwise constitutes prior art under the applicable statutory provisions and/or is known to be relevant to an attempt to solve any problem with which the present disclosure is concerned.

During construction, many framing techniques are used. One of such techniques includes manual assembly of multiple framing components into a single framing element. However, such assembly is inefficient for various reasons. For example, manual assembly involves excessive material, which is costly. Similarly, manual assembly wastes man-hours, which are also costly. Resultantly, better approaches are desired.

While certain aspects of conventional technologies have been discussed to facilitate the present disclosure, no technical aspects are disclaimed. The claims may encompass at least one of the conventional technical aspects discussed herein.

BRIEF SUMMARY

The present disclosure may at least partially address at least one of the above. However, the present disclosure may prove useful to other technical areas. Therefore, the claims should not be construed as necessarily limited to addressing any of the above.

According to an example embodiment of the present disclosure a framing element is provided. The framing element includes an F-shaped body defined via a spine, a first flange extending from the spine, and a second flange extending from the spine. The body is unitary. The first flange having a flange end portion distal to the spine. The flange end portion including a first track. The spine having a spine end portion distal to the first flange. The spine end portion including a second track. The second flange is between the first flange and the second track.

According to another example embodiment of the present disclosure a method is provided. The method includes manufacturing a framing element. The element comprising an F-shaped body defined via a spine, a first flange extending from the spine, and a second flange extending from the spine. The body is unitary. The first flange having a flange end portion distal to the spine. The flange end portion including a first track. The spine having a spine end portion distal to the first flange. The spine end portion including a second track. The second flange is between the first flange and the second track.

According to yet another example embodiment of the present disclosure a method is provided. The method includes installing a framing element. The element comprising an F-shaped body defined via a spine, a first flange extending from the spine, and a second flange extending from the spine. The body is unitary. The first flange having a flange end portion distal to the spine. The flange end portion including a first track. The spine having a spine end portion distal to the first flange. The spine end portion including a second track. The second flange is between the first flange and the second track.

The present disclosure may be embodied in the form illustrated in the accompanying drawings. Attention is called to the fact, however, that the drawings are illustrative. Variations are contemplated as being part of the present disclosure, limited only by the scope of the claims.

BRIEF DESCRIPTION OF THE DRAWINGS

The accompanying drawings illustrate example embodiments of the present disclosure. Such drawings are not to be construed as necessarily limiting the present disclosure. Like numbers and/or similar numbering scheme can refer to like and/or similar elements throughout.

DETAILED DESCRIPTION OF THE PREFERRED EMBODIMENTS

Figure 1:
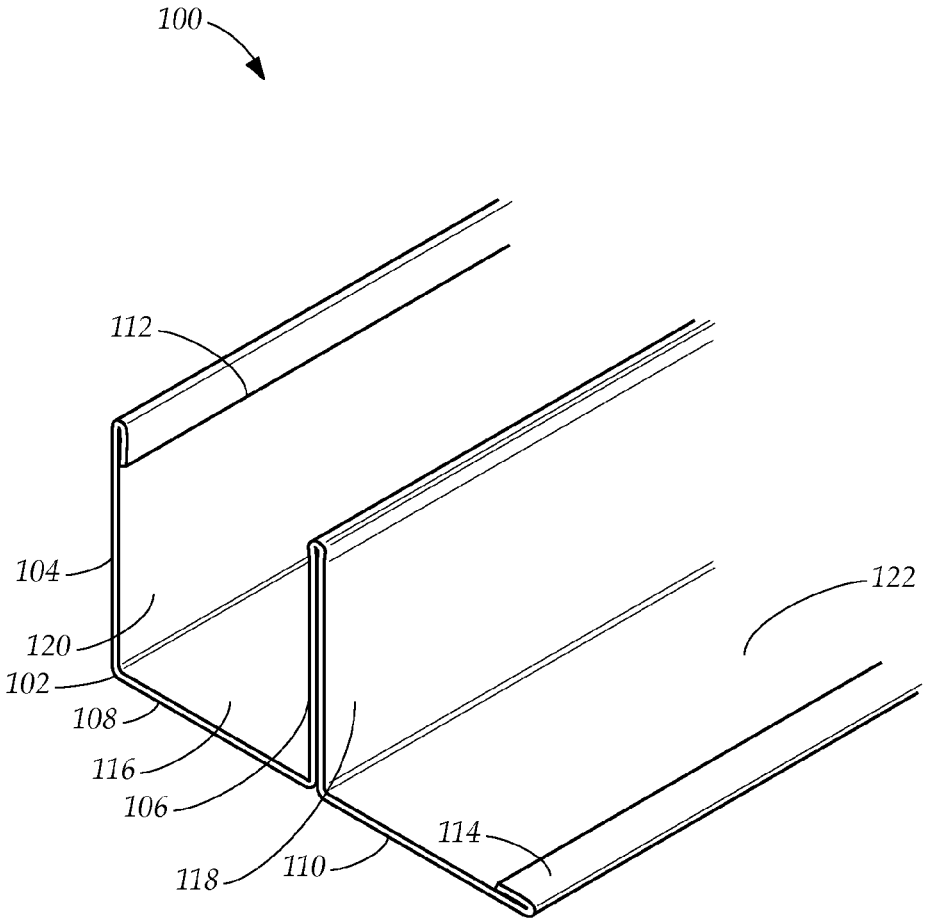
FIG. 1 shows a perspective view of an example embodiment of a framing element according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art. In addition, features described with respect to certain example embodiments may be combined in and/or with various other example embodiments. Different aspects and/or elements of example embodiments, as disclosed herein, may be combined in a similar manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular example embodiments only and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, reflection, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

U.S. patent application Ser. No. 29/453,718, filed on May 2, 2013, is herein fully incorporated by reference for all purposes. If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

FIG. 1 shows a perspective view of an example embodiment of a framing element according to the present disclosure. A framing element 100 includes a body 102, a first flange 104, and a second flange 106, which when viewed together appear F-shaped. Any and/or all elements and/or sub-elements of element 100 can include metal, steel, galvanized and/or un-galvanized, alloys, plastic, polymers, wood, rubber, diamonds, stone, nano-particles and/or any other materials. Any and/or all elements and/or sub-elements of element 100 can be linear or non-linear, such as winding, zigzag, wavy, curvy and/or others. Any and/or all elements and/or sub-elements of element 100 can be corrosive, non-corrosive, waterproof, non-waterproof, weatherproof, non-weatherproof and/or any combinations thereof.

Body 102 includes a discontinuous spine, as bisected by flange 106. Due to such bisection, the spine has a first spine portion 108 and a second spine portion 110. Portion 108 can be identically sized as portion 110, whether in length, height, width, volume and/or surface area. Portion 108 can be sized differently from portion 110, whether in length, height, width, volume and/or surface area, whether larger or smaller in any combination. Portion 108 can contain identical materials as portion 110, such as a metal and/or an alloy. Portion 108 can contain materials different from portion 110, such as a metal and/or an alloy. Portion 108 can be identically coated as portion 110, such as magnetically, adhesively and/or others. Portion 108 can be coated differently from portion 110, such as magnetically, adhesively and/or others. At least one of portion 108 and portion 110 can be electrically conductive and/or thermally conductive. At least one of portion 108 and portion 110 can be electrically insulating and/or thermally insulating. Portion 108 can be identically surfaced, whether internally and/or externally, as portion 110, such as patterned, textured, rough, smooth and/or others. Portion 108 can be differently surfaced, whether internally and/or externally, as portion 110, such as patterned, textured, rough, smooth and/or others. Portion 108 includes an inner surface 116 in-between flange 104 and flange 106. Portion 110 includes an inner surface 122. At least one of portion 108 and portion 110 can be rigid, flexible and/or any combination thereof.

Although flange 106 bisects the spine in a folded manner, flange 106 can bisect the spine in a non-folded manner such that portion 108 and portion 110 are continuous along the spine from where flange 106 extends out from. For example, flange 106 can extend from the spine like flange 104. The spine can include more than two spine portions. At least one of portion 108 and portion 110 can include sub-spine portions.

Flange 104 extends from portion 108. Flange 104 is unitary with respect to portion 108. Flange 104 can be identically sized as portion 108 and/or portion 110, whether in length, height, width and/or surface area. Flange 104 can be differently sized as portion 108 and/or portion 110, whether in length, height, width and/or surface area, whether larger or smaller in any combination. Flange 104 can contain identical materials as portion 108 and/or portion 110, such as a metal and/or an alloy. Flange 104 can contain different materials as portion 108 and/or portion 110, such as a metal and/or an alloy. Flange 104 can be identically coated as portion 108 and/or portion 110, such as magnetically, adhesively and/or others. Flange 104 can be differently coated as portion 108 and/or portion 110, such as magnetically, adhesively and/or others. Flange 104 can be electrically conductive and/or thermally conductive, such as and/or different from at least one of portion 108 and portion 110. Flange 104 can be electrically insulating and/or thermally insulating, such as and/or different from at least one of portion 108 and portion 110. Flange 104 can be identically surfaced, whether internally and/or externally, as portion 108 and/or portion 110, such as patterned, textured, rough, smooth and/or others. Flange 104 can be differently surfaced, whether internally and/or externally, as portion 108 and/or portion 110, such as patterned, textured, rough, smooth and/or others. Although flange 104 is structured in a non-folded manner, flange 104 can be structured in a folded manner, such as flange 106. Flange 104 includes an inner surface 120.

Flange 104 is perpendicular to portion 108. However, flange 104 can be angled in other configurations. For example, flange 104 can be inclining away from flange 106, such as being within about 120 degrees with respect to portion 108 i.e. within about 30 degree incline from about 90 degrees. Also for example, flange 104 can be inclining toward flange 106, such being within about 60 degrees with respect to portion 108 i.e. within about 30 degree incline from about 90 degrees.

Flange 104 includes a flange end distal to portion 108. The end includes a first internal track 112, which includes a first lip curved inward toward portion 108 along surface 120. Track 112 can be drop/droplet shaped, such as a raindrop. Note that other types of track 112 are possible. For example, although track 112 is smoothly curved, track 112 can be curved in an acute or rounded manner.

Flange 106 extends from portion 108 and portion 110. Flange 106 is unitary with respect to portion 108 and portion 110. Flange 106 can be identically sized as flange 104, portion 108 and/or portion 110, whether in length, height, width and/or surface area. Flange 106 can be differently sized as flange 104, portion 108 and/or portion 110, whether in length, height, width and/or surface area. Flange 106 can contain identical materials as flange 104, portion 108 and/or portion 110, such as a metal and/or an alloy. Flange 106 can contain different materials as flange 104, portion 108 and/or portion 110, such as a metal and/or an alloy. Flange 106 can be identically coated as flange 104, portion 108 and/or portion 110, such as magnetically, adhesively and/or others. Flange 106 can be coated differently from flange 104, portion 108 and/or portion 110, such as magnetically, adhesively and/or others. Flange 106 can be electrically conductive and/or thermally conductive, such as and/or different from at least one of flange 104, portion 108 and portion 110. Flange 106 can be electrically insulating and/or thermally insulating, such as and/or different from at least one of flange 104, portion 108 and portion 110. Flange 106 can be identically surfaced, whether internally and/or externally, as flange 104, portion 108 and/or portion 110, such as patterned, textured, rough, smooth and/or others. Flange 106 can be surfaced differently, whether internally and/or externally, from flange 104, portion 108 and/or portion 110, such as patterned, textured, rough, smooth and/or others. Flange 106 is structured in a folded manner. Such folds can include a plurality of sub-folds of any number in any combination in any shape. However, flange 106 can be structured in a non-folded manner, such as flange 104. Flange 106 includes a lower inner surface 118.

Flange 106 is perpendicular to portion 108 and/or portion 110. However, flange 106 can be angled in other configurations. For example, flange 106 can be inclining away from flange 104, such as being within about 120 degrees with respect to portion 108 i.e. within about 30 degree incline from about 90 degrees. Also for example, flange 106 can be inclining toward flange 104, such being within about 60 degrees with respect to portion 108 i.e. within about 30 degree incline from about 90 degrees. Flange 106 can be parallel to flange 104. Flange 106 can be non-parallel to flange 104, such as in a converging orientation or a diverging orientation. Flange 106 and flange 104 can be extending from the spine partially or fully equidistant. Flange 106 and flange 104 can be extending from the spine partially or fully non-equidistant.

Portion 110 includes a spine end distal to flange 106. The end includes a second internal track 114, which includes a second lip curved inward toward surface 118 along surface 122. Track 114 can be drop/droplet shaped, such as a raindrop Note that other types of track 114 are possible. For example, although track 114 is smoothly curved, track 114 can be curved in an acute or rounded manner. Track 114 can be identical to and/or different from track 112, whether in length, width, height, surface area, volume, shape, texture and/or others. At least one of track 112 and track 114 can include at least one sub-track. Flange 106 can be folded in a similar manner as at least one of track 112 and track 114.

Element 100 with body 102, flange 104, flange 106, portion 108, portion 110, track 112 and track 114 are unitary. Element 100 can be manufactured manually and/or automatically. Such manufacturing can include at least one of die-cutting, stamping, molding, 3-D printing and other similar methods, irrespective of any relation to framing. Resultantly, element 100 includes F-shaped body 102 defined via flange 104 extending from the spine, such as portion 108, and flange 106 extending from the spine, such as portion 110. The spine, flange 104 and flange 106 are unitary. Flange 104 has the flange end distal to the spine, such as portion 108. The flange end has track 112. The spine, such as portion 110, has the spine end distal to flange 106. The spine end has track 114. Flange 106 bisects the spine such that flange 106 is between flange 104 and the spine end.

In another example embodiment, element 100 can include a third flange, similar to at least one of flange 104 and flange 106. The third flange can extend from the spine and along the spine, similar to at least one of flange 104 and flange 106. The third flange can extend on portion 108 along surface 116 between flange 104 and flange 106. Such extension can be anywhere on portion 108 along surface 116 between flange 104 and flange 106. Such extension can be parallel, non-parallel, equidistant, non-equidistant in any manner with respect to at least one of flange 104 and flange 106. For example, such extension can appear E-shaped with the third flange being intermediate to flange 104 and flange 106. The third flange can include a track, such as at least one of track 112 and 114, on any surface in any area of the third flange.

However, in yet another example embodiment, the third flange can extend from an opposing surface of the spine, such as the surface opposing surface 116 on portion 108. Therefore, the third flange can extend on the opposing surface from the spine and along the spine, similar to at least one of flange 104 and flange 106. The third flange can extend on portion 108 along the opposing surface between flange 104 and flange 106. Such extension can be anywhere on portion 108 along the opposing surface between flange 104 and flange 106. Such extension can be parallel, non-parallel, equidistant, non-equidistant in any manner with respect to at least one of flange 104 and flange 106. For example, such extension can appear T-shaped with the third flange being co-planar with flange 104. The third flange can include a track, such as at least one of track 112 and 114, on any surface in any area of the third flange.

In yet still another example embodiment, the third flange can extend on portion 110 along surface 122 between flange 106 and track 114. Such extension can be anywhere on portion 110 along surface 122 between flange 106 and track 114. Such extension can be parallel, non-parallel, equidistant, non-equidistant in any manner with respect to at least one of flange 104 and flange 106 and/or track 114. For example, such extension can appear F-shaped with the third flange being intermediate to flange 106 and track 114. The third flange can include a track, such as at least one of track 112 and 114, on any surface in any area of the third flange.

In even another example embodiment, the third flange can extend from an opposing surface of the spine, such as the surface opposing surface 122 on portion 110. Therefore, the third flange can extend on the opposing surface from the spine and along the spine, similar to at least one of flange 104 and flange 106. The third flange can extend on portion 110 along the opposing surface between flange 106 and track 114. Such extension can be anywhere on portion 110 along the opposing surface between flange 106 and track 114. Such extension can be parallel, non-parallel, equidistant, non-equidistant in any manner with respect to at least one of flange 104 and flange 106. For example, such extension can appear T-shaped with the third flange being co-planar with flange 106. Also for example, such extension can appear L-shaped with the third flange being perpendicular to portion 110 as extending from the opposing surface opposite track 114. The third flange can include a track, such as at least one of track 112 and 114, on any surface in any area of the third flange.

In even still another example embodiment, each of flange 104 and flange 106 can be about 10 inches long, about 1.25 inches tall. Portion 108 can be about 2.5 inches wide, spacing the first flange 104 from the second flange 106 by 2.5 inches along spine portion 108, and portion 110 can be about 1.25 inches wide for a total of about 3.75 inches for the spine. Portion 108, portion 110, flange 104 and/or flange 106 can range in thickness or be identical to each other in thickness. For example, such thickness can range between about 0.3 inches to about 0.0049 inches. Also, element 100 can be about 10 feet long. However, note that element 100 can be manufactured according to a standard or a custom request. Also, note that when the spine, flange 104, flange 106, track 112 and track 114 are unitary, installation time is saved, which can save money and speed up framing, and less manufacturing material is wasted, which can save money and speed up manufacturing.

Note that more than three flanges can be used. For example, any and/or all flanges as disclosed herein can have at least one sub-flange extending therefrom in any direction in any angle. The at least one sub-flange can be similar to at least one of flange 104 and flange 106. Also, note that more than two track can be used with any example embodiments as disclosed herein.

Note that element 100 can be used with stud and track framing, sidewall framing, soffit framing, fascia framing, curtain wall framing, and/or others. Also, element 100 can be used in attaching horizontal framing portion of a ceiling to vertical framing portion of a soffit in an efficient manner. Also, element 100 can be used in conjunction with wall studs, such as metallic, steel, wood and/or others. Also element 100 can be used in conjunction with other framing members, such as a hat track, a furring channel and/or others. Also, element 100 can include periodic markings and/or indentations, such as every 16 inches, for standard framing layout. However, other increments could be included as well in any measurement system.

Figure 2:
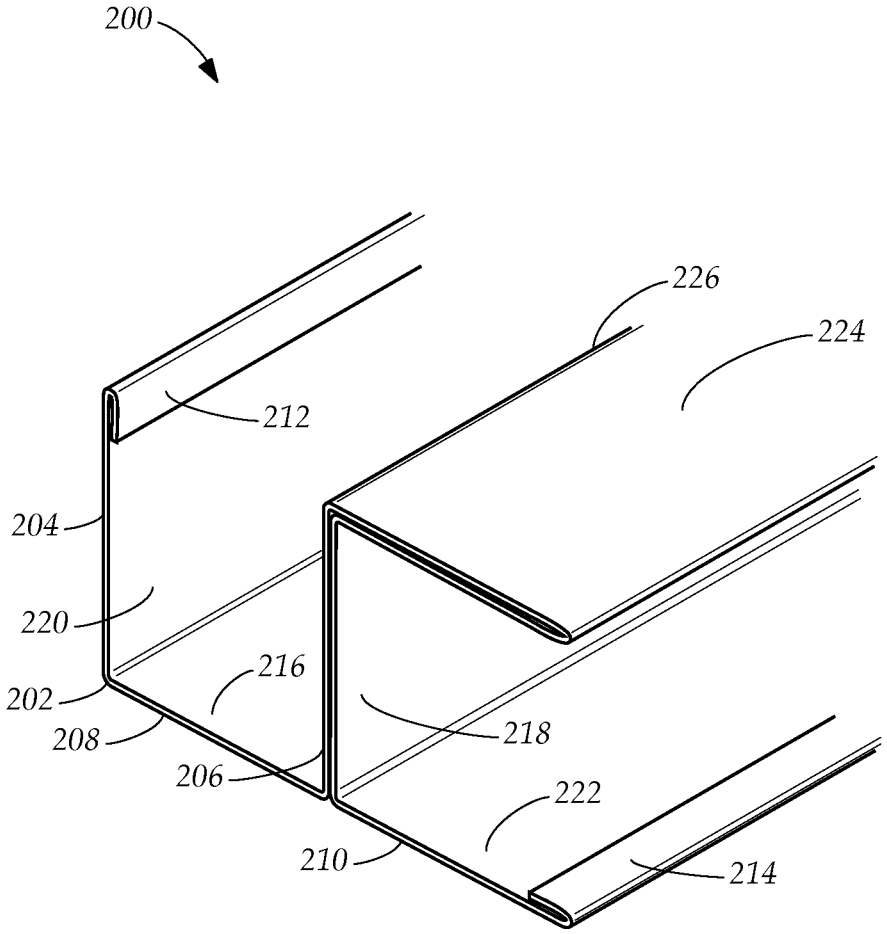
FIG. 2 shows a perspective view of another example embodiment of a framing element according to the present disclosure.

FIG. 2 shows a perspective view of another example embodiment of a framing element according to the present disclosure. Some elements of this figure are described above. Thus, same and/or similar reference characters identify same and/or like components described above and any repetitive detailed description thereof will hereinafter be omitted or simplified in order to avoid complication.

Element 200 includes a leg 224 extending from flange 206 at a fold 226. Portion 208, portion 210, flange 206 and leg 224 appear as h-shaped. Leg 224 is perpendicular to flange 206. However, leg 224 can be angled in other configurations. For example, leg 224 can be inclining away from surface 222, such as being within about 120 degrees with respect to flange 206 i.e. within about 30 degree incline from about 90 degrees. Also for example, leg 224 can be inclining toward surface 222, such being within about 60 degrees with respect to flange 206 i.e. within about 30 degree incline from about 90 degrees. Leg 224 can be parallel to portion 210 and/or surface 222. Leg 224 can be non-parallel to portion 210 and/or surface 222, such as in a converging orientation or a diverging orientation. Portion 210 and leg 224 can be extending partially or fully equidistant from flange 206. Portion 210 and leg 224 can be extending partially or fully non-equidistant from flange 206.

Leg 224 is structured in a folded manner. Such folds can include a plurality of sub-folds of any number in any combination in any shape. Such folding can be identical to folding of flange 206 or different from folding of flange 206. Note that leg 224 can also be structured in a non-folded manner, such as flange 104. Also, leg 224 can include a track, such as track 212 or track 214, thereon. For example, such track can be internally positioned, such as opposing and facing track 214, or externally positioned. Such positioning can be anywhere on leg 224, whether at any peripheral section, lateral section, edge or middle area of leg 224.

Leg 224 is unitary with respect to flange 266, but can be an assembled as well. Leg 224 can be identically sized as flange 204, flange 206, portion 208 and/or portion 210, whether in length, height, width and/or surface area. Leg 224 can be sized differently from flange 204, flange 206, portion 208 and/or portion 210, whether in length, height, width and/or surface area, whether larger or smaller in any combination. Leg 224 can contain identical materials as flange 204, flange 206, portion 208 and/or portion 210, such as a metal and/or an alloy. Leg 224 can contain materials different from flange 204, flange 206, portion 208 and/or portion 210, such as a metal and/or an alloy. Leg 224 can be identically coated as flange 204, flange 206, portion 208 and/or portion 210, such as magnetically, adhesively and/or others. Leg 224 can be coated differently from flange 204, flange 206, portion 208 and/or portion 210, such as magnetically, adhesively and/or others. Leg 224 can be electrically conductive and/or thermally conductive, such as and/or different from at least one of flange 204, flange 206, portion 208 and/or portion 210. Leg 224 can be electrically insulating and/or thermally insulating, such as and/or different from at least one of flange 204, flange 206, portion 208 and/or portion 210. Leg 224 can be identically surfaced, whether internally and/or externally, as flange 204, flange 206, portion 208 and/or portion 210, such as patterned, textured, rough, smooth and/or others. Leg 224 can be surfaced differently, whether internally and/or externally, from flange 204, flange 206, portion 208 and/or portion 210, such as patterned, textured, rough, smooth and/or others.

Note that in other example embodiments, leg 224 can include the third flange, as described above. Also, note that in still other example embodiments, at least some elements and/or sub-elements of element 200 can be sized similarly at least some elements and/or sub-elements of element 100. Also, note that element 200 can be used in a similar manner as element 100.

Figure 3:
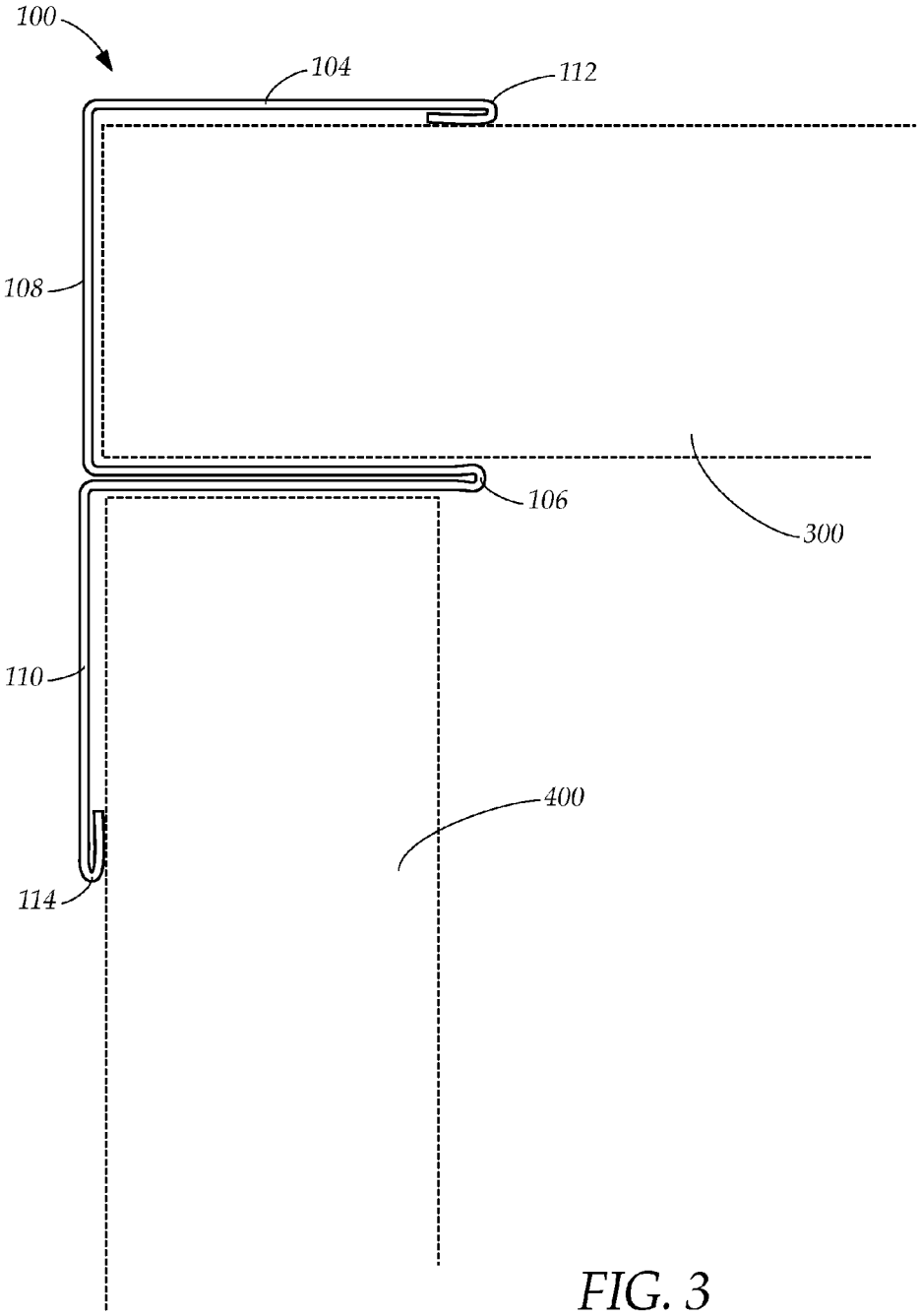
FIG. 3 shows a side view of an example embodiment of a framing element used with a plurality of other framing elements according to the present disclosure.

FIG. 3 shows a side view of an example embodiment of a framing element used with framing members 300 and 400 according to the present disclosure. Some elements of this figure are described above. Thus, same and/or similar reference characters identify same and/or like components described above and any repetitive detailed description thereof will hereinafter be omitted or simplified in order to avoid complication. Note that FIG. 3 shows how the framing element can be formed from a single sheet of material. In particular the material extends initially from the first flange end, where it may be rolled to form and terminate in the first track 112, to form the first flange 104. Then the material continues in one plane without interruption until it is bent by ninety degrees to begin forming the spine, in particular portion 108 of the spine. Then the material continues in one plane until it is bent by ninety degrees to extend perpendicularly away from spine portion 108, parallel to first flange 104, to begin forming the second flange 106. The material is bent one hundred eight degrees to return along itself to continue forming the second flange 106. The material continues in one plane until it is bent ninety degrees to continue forming the spine, namely portion 110, as it continues to the spine end portion, where it may be rolled to form and terminate in the second track 114.

Framing member 300 and a framing member 400 are used with element 100. An end portion of member 300 is positioned along portion 108 between flange 104 and flange 106 and passed track 112. An end portion of member 400 is positioned along portion 110 from flange 106 and passed track 114. Member 300 and member 400 can be identical to or different from each other in any way.

Figure 4:
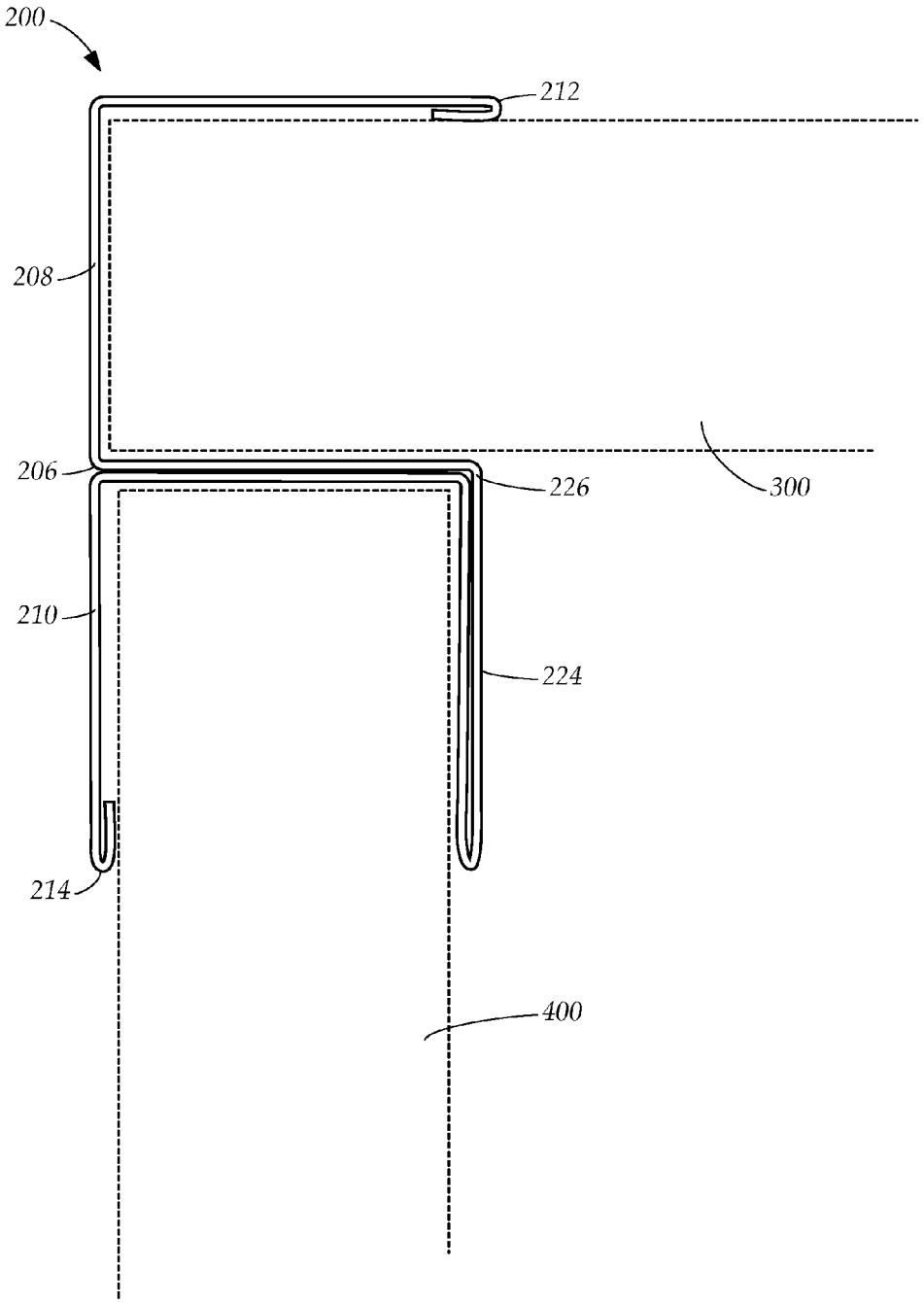
FIG. 4 shows a side view of another example embodiment of a framing element used with a plurality of other framing elements according to the present disclosure.

FIG. 4 shows a side view of another example embodiment of a framing element used with a plurality of framing members according to the present disclosure. Some elements of this figure are described above. Thus, same and/or similar reference characters identify same and/or like components described above and any repetitive detailed description thereof will hereinafter be omitted or simplified in order to avoid complication.

Framing member 300 and frame member 400 are used with element 200. The end portion of member 300 is positioned along portion 208 between flange 204 and flange 206 and passed track 212. The end portion of member 400 is positioned between portion 210 and leg 224 along portion 210 from flange 206 and passed track 214.

Figure 5:
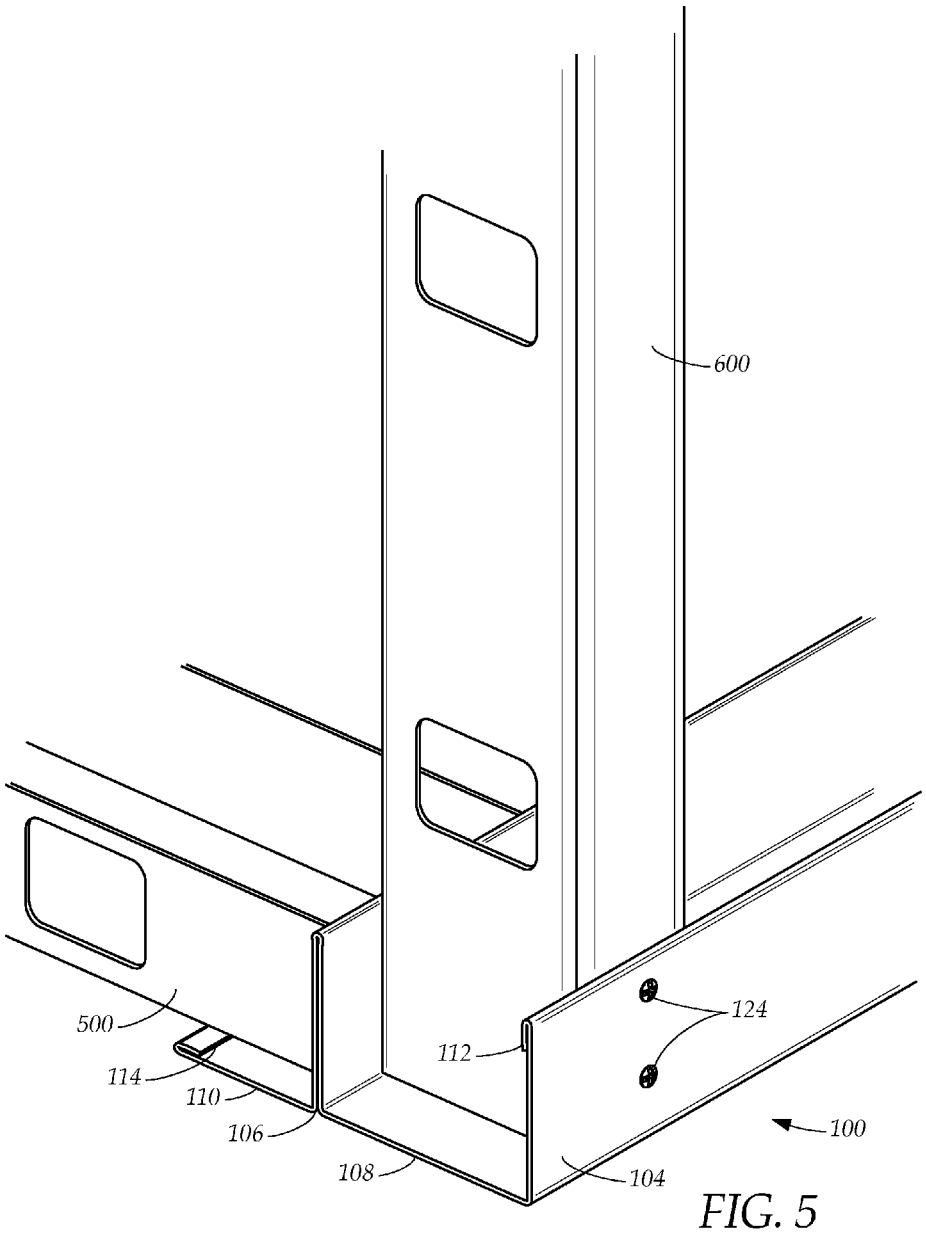
FIG. 5 shows a perspective view of an example embodiment of a framing element used with a plurality of other framing elements according to the present disclosure.

FIG. 5 shows a perspective view of an example embodiment of a framing element used with a plurality of framing members according to the present disclosure. Some elements of this figure are described above. Thus, same and/or similar reference characters identify same and/or like components described above and any repetitive detailed description thereof will hereinafter be omitted or simplified in order to avoid complication.

A framing member 500 and a frame member 600 are used with element 100. An end portion of member 600 is positioned along portion 108 between flange 104 and flange 106 and passed track 112. Note that a plurality of fasteners 124 protrude through flange 104 into member 600 for fastening purposes. Fasteners 124 can include nails, screws, bolts and others of any types. Fasteners 124 can include metal, steel, wood, plastic and/or other materials. Similar type of fastening can occur through flange 106.

An end portion of member 500 is positioned along portion 110 from flange 106 and passed track 114. Member 300 and member 400 can be identical to or different from each other in any way. Note that element 200 can also be used with member 500 and 600 in an identical or different manner.

Figure 6:
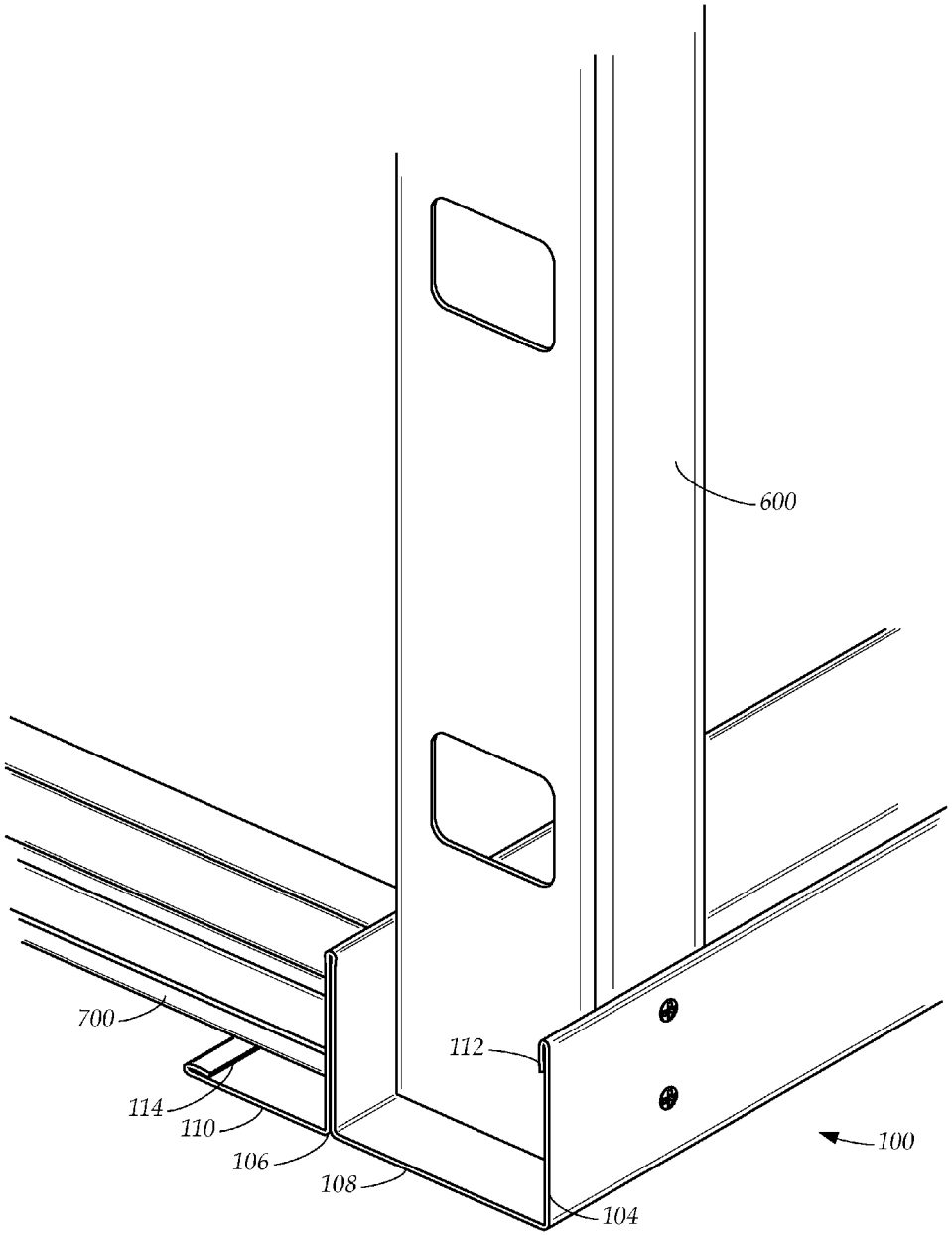
FIG. 6 shows a perspective view of an example embodiment of a framing element used with a plurality of other framing elements according to the present disclosure.

FIG. 6 shows a perspective view of an example embodiment of a framing element used with a plurality of framing members according to the present disclosure. Some elements of this figure are described above. Thus, same and/or similar reference characters identify same and/or like components described above and any repetitive detailed description thereof will hereinafter be omitted or simplified in order to avoid complication.

A framing member 700 is used with element 100. Member 700 is a furring channel, which can be U-shaped and can include tracked ends. Note that element 200 can also be used with members 700 and 600 in an identical or different manner.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of this application.

What is claimed is:

1. A method of installing a framing element, the framing element having an F-shaped body having a spine, a first flange extending perpendicularly from said spine, and having a second flange extending perpendicularly from said spine and parallel to said first flange, the spine extending continuously without interruption in one plane between the first flange and second flange, said spine having a spine end portion beyond said second flange and fully opposite from said first flange, using a first framing member and a second framing member, comprising the steps of:

extending the first framing member against the spine between the first flange and the second flange;

securing said first framing member by extending fasteners through the first flange and into said first framing member; and extending the second framing member perpendicular to the first framing member, and simultaneously against the spine, including the spine and portion, and against the second flange such that said second framing member abuts the second flange immediately opposite from the first framing member.

* * * * *